US005514250A

United States Patent [19]

Boula et al.

[11] Patent Number: 5,514,250

[45] Date of Patent: May 7, 1996

[54] DEVICE FOR ANTIVIBRATIONAL BLOCKING OF TUBES OF A HEAT EXCHANGER

[75] Inventors: Gérard Boula, Corpeau; Christian Valadon, Paris, both of France

[73] Assignee: Framatome, Courbevoie, France

[21] Appl. No.: 324,660

[22] Filed: Oct. 18, 1994

[30] Foreign Application Priority Data

Oct. 20, 1993 [FR] France ..... 93 12514

[51] Int. Cl.[6] ..... F22B 37/24

[52] U.S. Cl. ..... 165/69; 165/162; 122/510

[58] Field of Search ..... 376/285, 402, 376/405; 165/69, 81, 162; 122/510

[56] References Cited

U.S. PATENT DOCUMENTS 5,127,469 7/1992 Boula ..... 165/69

FOREIGN PATENT DOCUMENTS 2664965 1/1992 France .

*Primary Examiner*—Daniel D. Wasil

*Attorney, Agent, or Firm*—Pollock, Vande Sande & Priddy

[57] ABSTRACT

The blocking device includes sets of antivibration bars (25, 25') interposed between layers of tubes (24) of the bundle of the steam generator, in the upper part of the bundle, termed the tube bend region. The antivibration bars (25, 25') include parts (25*b*, 25'*b*) which project with respect to the tube bend region, and the blocking device includes a linkage of the end parts of the antivibration bars, which include aligned openings. The linkage includes a screw (21) whose head (21*a*) bears on a first antivibration bar (25) and whose threaded rod (21*b*) is screwed into a spacer (22). The spacer (22) is fixed either in a second spacer or in a tapped fastening element (23), by a threaded part (22*b*). The threaded parts (21*b*) of the screw and (22*b*) of the spacer pass through the antivibration bars (25, 25') through aligned openings.

6 Claims, 6 Drawing Sheets

DEVICE FOR ANTIVIBRATIONAL BLOCKING OF TUBES OF A HEAT EXCHANGER

FIELD OF THE INVENTION

The invention relates to a device for anti-vibrational blocking of tubes of a heat exchanger such as a steam generator.

BACKGROUND OF THE INVENTION

Steam generators of pressurized water nuclear reactors include tubes folded into a U, having two branches clamped at their ends in a tube plate. The tubes are arranged in adjacent planar layers. The curved parts of the tubes of the bundle which are juxtaposed at its upper part have radii of curvature which are different from each other and are placed adjacent to constitute a structure of substantially hemispherical shape termed the tube bend region.

During the operation of the steam generator, high-temperature pressurized water flows in the tubes of the bundle and feedwater is brought into contact with the outer surface of these tubes, along which it moves in the vertical direction while heating and then vaporizing, to reemerge in the form of steam at the upper part of the generator.

The flow of the fluid in contact with the tubes may cause vibrations which can lead to damage of tubes if they are not held efficiently.

The straight part of the tubes is engaged in spacers situated at regular distances from each other along the height of the bundle. These straight parts are therefore effectively held by rigid elements. The curved parts of the tubes of the bundle which constitute the tube bend region must also be held, and for this purpose spacer bars are interposed between two adjacent tube layers of the bundle and are arranged along substantially radial directions of the tube bend region.

These spacer bars are generally connected in pairs in an articulated manner at the one of their ends which is arranged inside the tube bend region and are placed angularly to constitute V-shaped structures.

The outer ends of the antivibration bars which are opposite their central part project with respect to the tubes constituting the outer level of the tube bend region and are connected together by linkage means which hold the antivibration bars.

Various means for linking of the outer ends of the antivibration bars have been proposed, using fastening elements placed above the upper surface of the tube bend region.

It has, for example, been proposed to weld the ends of the antivibration bars onto curved elements arranged along meridian planes of the tube bend region.

It has also been proposed to fasten the ends of the antivibration bars, for example by welding, onto substantially parallel rings or retaining pins arranged above the upper surface of the tube bend region.

In any case, the fastening of the antivibration bars requires complex operations most often involving welding which must be carried out in the vicinity of the tubes of the bundle, which thus risk undergoing some degree of damage. Furthermore, the materials constituting the antivibration bars must be chosen to allow their welding and optionally their treatment after welding, under good metallurgical conditions.

Mechanical linkage devices have also been proposed which make it possible to connect the outer ends of the antivibration bars to fastening components such as retaining rings arranged above the outer surface of the tube bend region.

These devices are relatively complex and require for their fastening the use of heavy and bulky additional elements attached onto the tube bend region. Furthermore, these devices do not ensure very close alignment of the antivibration bars and precise adjustment of the clearance between two successive antivibration bars between which a layer of tubes is interposed.

In FR-A-2,664,965, shows a blocking device which includes means of linkage between the outer ends of antivibration bars arranged in sets of at least two bars, in which the bars are aligned and include aligned through openings, one of which is tapped. The means of linkage of the antivibration bars include a pin which is introduced into the aligned openings of the set of antivibration bars and into the bore of spacers which are each interposed between two successive antivibration bars. The pin, which has a threaded end, is screwed in the tapped opening of an antivibration bar situated at the end of the row. The pin is also solidly attached to a rotational locking element which can be welded onto a spacer. Such a device has advantages over prior art mechanical devices, but requires the use of pins whose length is adapted to the number of bars and to the length of the row of antivibration bars whose ends are assembled together. In certain cases, it is necessary to use a very long pin, which may present problems as regards the conditions of placement and the mechanical strength of the pin.

SUMMARY OF THE INVENTION

The object of the invention is therefore to provide a device for antivibrational blocking of tubes of a heat exchanger including a bundle of tubes folded into a U, fixed at their ends in a tube plate arranged in parallel layers and whose juxtaposed bent parts opposite the tube plate constitute an assembly of substantially hemispherical shape termed the tube bend region. The blocking device includes a set of antivibration bars each interposed between the bent parts of two adjacent layers of tubes of the bundle and arranged in a substantially radial direction of the tube bend region, so as to have one end outside the tube bend region, and means of linkage between the outer end parts of the antivibration bars arranged in a plurality of sets of at least two bars in which the bars are aligned along a straight row and include aligned through openings, this blocking device employing modular elements which can easily be adapted to any number of bars and to a row of bars of any length.

For this purpose, the means of linkage between the ends of the antivibration bars include, for each of the sets of antivibration bars aligned along one row:

a screw having a head intended to bear on a first face of a first antivibration bar at one of the ends of the row and including means of locking in rotation with respect to the first antivibration bar and a threaded rod engaged in the opening of the first antivibration bar, so as to project on a second face of the first antivibration bar, opposite the first face, at least one spacer having a longitudinal axis and a body whose length along the axis of the spacer is substantially equal to the separation between two successive bars of the row and including, along the axis of the body, a tapped opening over part of the length of the body, emerging at a first axial end of the body of the spacer and a threaded rod in the axial extension of the body, at its longitudinal end opposite the first end as well as an engaging surface on the outer surface of the body, and a tapped fastening element associated with a second antivibration bar different from the first, the threaded rod of the screw having a screw thread allowing it to be screwed into the tapped opening of the spacer, and the threaded rod of the spacer having an identical screw thread allowing it to be fastened in the tapped opening of the fastening element or in a tapped spacer opening.

BRIEF DESCRIPTION OF THE DRAWINGS

In order better to explain the invention, a description will now be given, by way of example, referring to the annexed drawings, of a steam generator of a pressurized water nuclear reactor and a blocking device according to the invention, associated with this steam generator.

DETAILED DESCRIPTION

Figure 1:
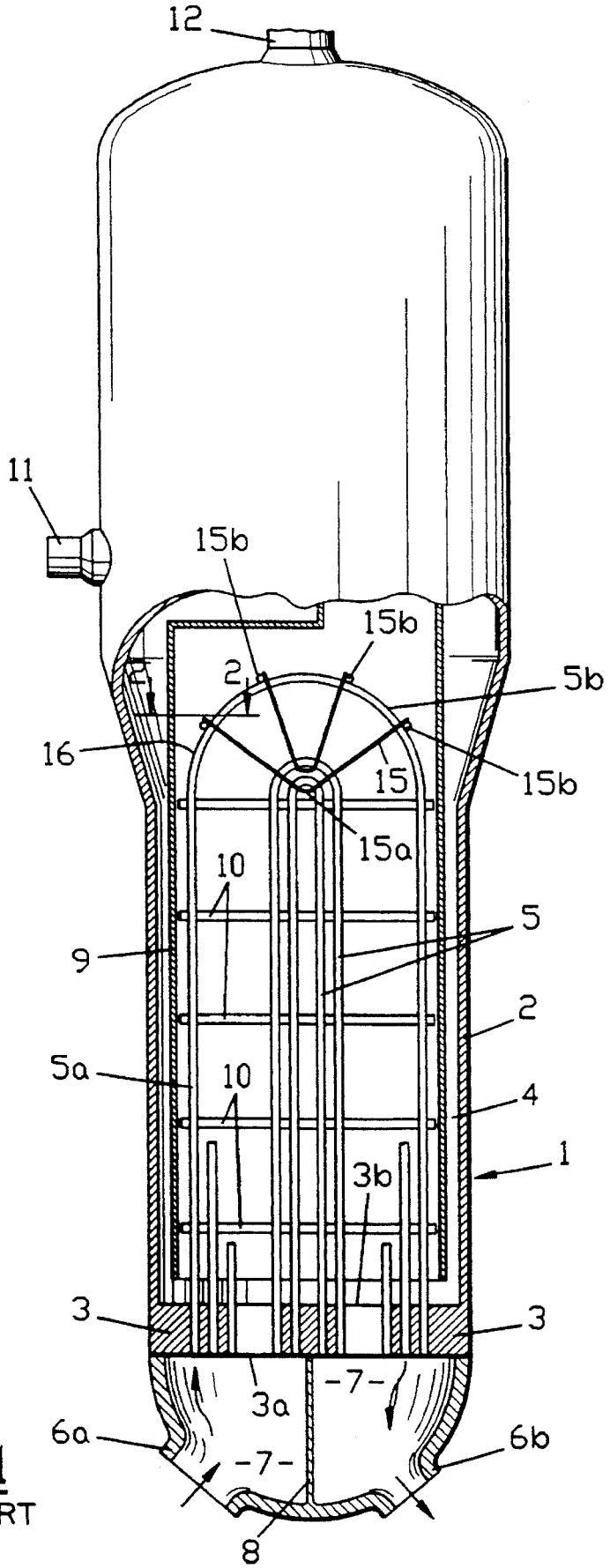
FIG.1 PRIOR ART
FIG. 1 is a view in elevation with partial section through a vertical plane of a steam generator of a pressurized water nuclear reactor.

FIG. 1 shows a steam generator of a pressurized water nuclear reactor 1 including an outer casing 2 connected, at its lower part, to a very thick tube plate 3.

The casing 2 contains the tube bundle of the steam generator which consists of tubes 5 bent into a U and including at their upper part semicircular bends 5*b* constituting the tube bend region of the steam generator.

The ends of the straight parts 5*a* of the tubes of the bundle are clamped in the tube plate 3, so as to emerge in a water box 7 in two parts separated by a partition 8.

The tube plate 3 is traversed by a regular network of holes, in each of which an end of a tube of the bundle is fastened.

The holes may, for example, have square cells or triangular cells.

Figure 2A:
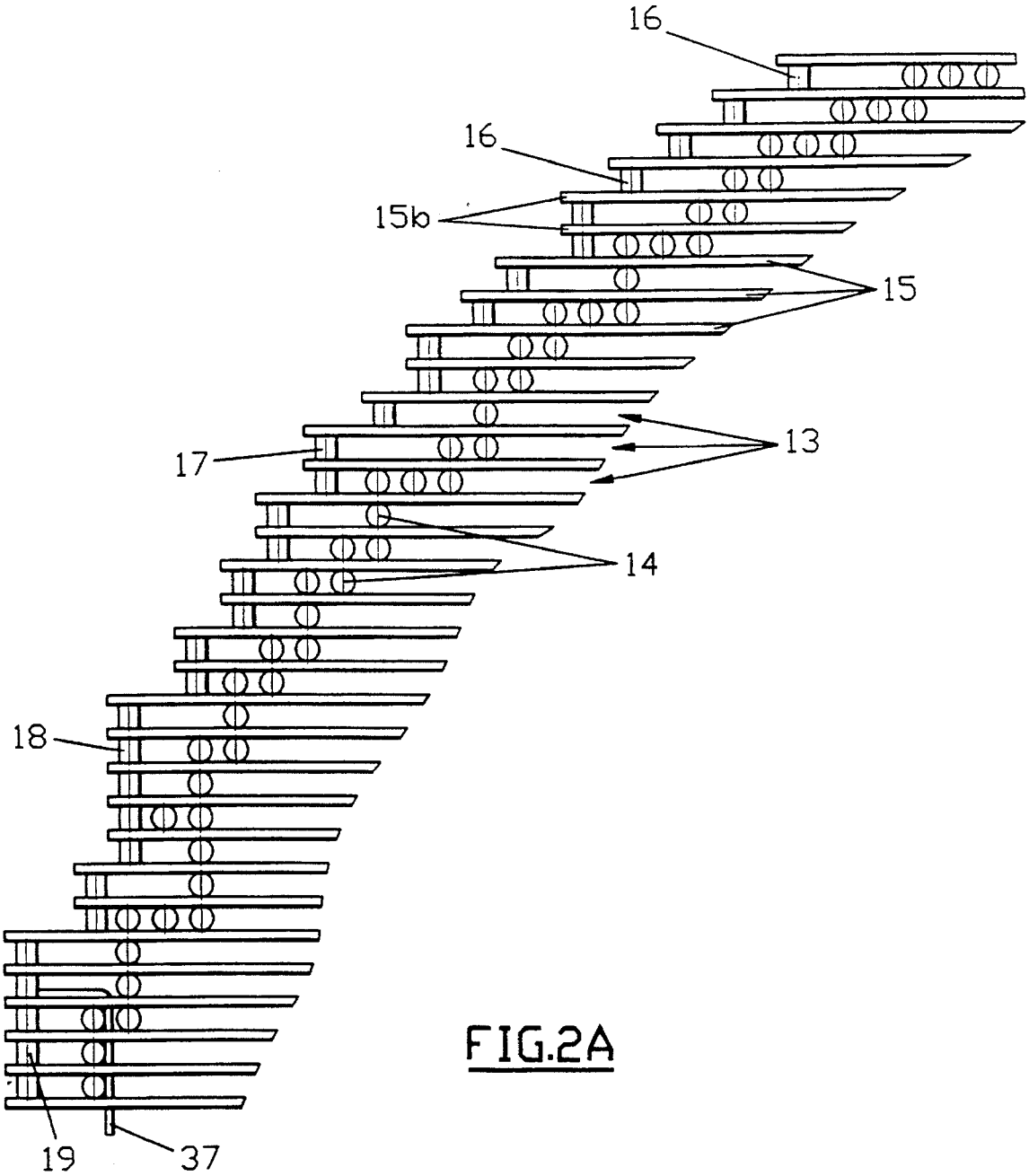
FIG. 2A is a partial view in plan and in section along line 2—2 in FIG. 1, of an upper part of the tube bend region of a steam generator having a tube network with square pitch and an antivibration blocking device according to the invention.
Figure 2B:
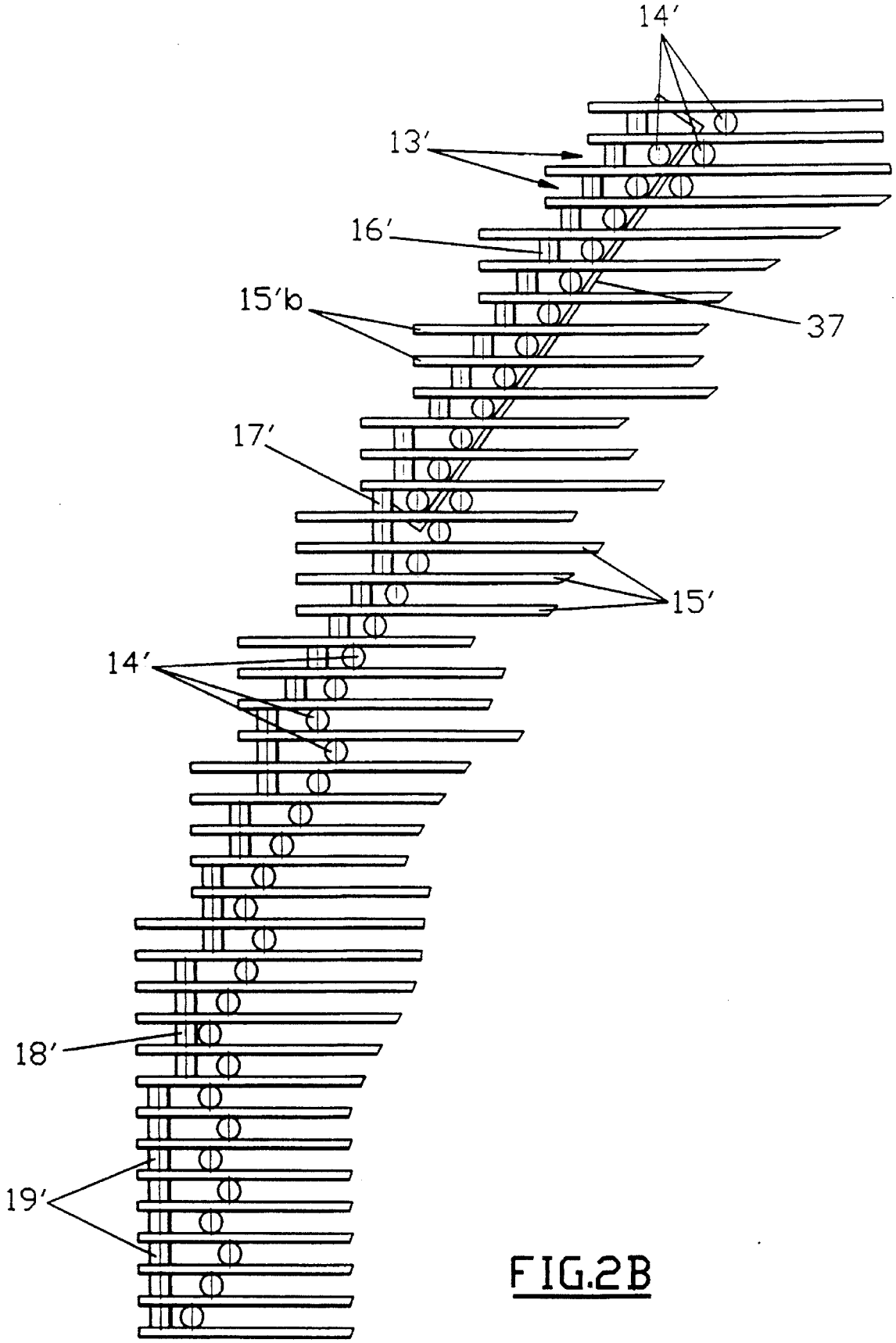
FIG. 2B is a view similar to FIG. 2A, in the case of a steam generator having a tube bundle with triangular pitch.

A part of a blocking device according to the invention is shown in FIGS. 2A and 2B, in the case of a bundle of tubes fixed into holes of a network with square cells passing through the tube plate, and in the case of a tube bundle held in holes forming a network with triangular cells, passing through the tube plate 3, respectively.

The pressurized cooling water of the nuclear reactor enters one of the parts of the water box 7 through an inlet nozzle 6*a*, flows through the tubes of the bundle and then reemerges through an outlet nozzle 6*b*. The tube bundle 5 is surrounded by a bundle wrapper 9 making it possible to channel the feedwater entering the casing of the steam generator through an inlet nozzle 11. The feedwater of the steam generator first flows downward in the annular space 4 situated around the bundle wrapper 9, then upward in contact with the tubes 5 of the bundle, so as to heat, then vaporize and reemerge in the form of steam to the upper nozzle 12 of the steam generator.

The upper part of the tube bundle, termed the tube bend region, consists of the juxtaposition of semicircular-shaped bends arranged in successive layers, in which the radii of the bends 5*b* decrease from the outside towards the inside of the bundle.

The various successive layers of tubes of the bundle, which are parallel to the central level and are represented in FIG. 1, include outer bends of outwardly decreasing diameters, such that the upper part of the bundle or tube bend region constitutes an assembly of substantially hemispherical shape.

The straight part 5*a* of the tubes 5 is held by spacer plates 10 which prevent vibration of the tubes under the effect of the flow of the exchange fluids when the steam generator is in service.

The bent parts 5*b* of the tubes situated at the upper end of the bundle, are held by V-shaped antivibration bars 15, which may or may not be articulated at their lower ends 15*a* and introduced between the levels of successive tubes at the bends.

The outer ends 15*b* of the branches of the antivibration bars project from the upper surface of the tube bend region and make it possible to fasten the antivibration bars.

The term antivibration bar will henceforth be used to denote any branch of a V-shaped assembly 15.

FIGS. 2A and 2B represent, in plan view with section of the layers of tubes in their upper part, a part of a blocking assembly according to the invention, in the case of a bundle of tubes held in a network arrangement with square cells and with triangular cells, respectively.

The tubes of the bundle are held in a regular network arrangement by the openings of the tube plate 3 and by the through openings of the spacer plates 10 which include similar networks of openings.

The arrangement of the tubes in the case of a network with triangular cells is in particular manifested by a space between the successive layers of tubes which is smaller than in the case of a network with square cells.

Fitting of the linkage means between the ends of the antivibration bars introduced between the layers of tubes is therefore more difficult in the case of a network with triangular cells, because of the smaller spacing between the layers and therefore between the antivibration bars inserted between the layers of tubes. The device according to the invention is particularly well suited to the case of a network of clamped tubes with triangular cells, but it may also be applied to the case of a network with square cells.

In FIGS. 2A and 2B, the corresponding elements carry the same references, with however the sign ' (prime) in the case of the elements in FIG. 2B relating to a network with triangular cells.

FIGS. 2A and 2B represent the tubes 14 or 14' of the network of tubes constituting the outer levels of the tube bend region of the steam generator.

The tubes 14 or 14' constitute successive parallel layers 13 or 13' between which the antivibration bars 15 or 15' are interposed.

In the part of the tube bundle of the steam generator constituting the tube bend region, the layers of tubes consist of the upper bent parts of the juxtaposed tubes, having radii which decrease from the outside towards the inside of the tube bend region.

The antivibration bars 15 include ends 15*b* projecting inside the tube bend region and arranged in alignment with each other to constitute rows of variable length.

The projecting ends 15*b* of the antivibration bars are connected together by linkage means such as 16, 17, 18 and 19, respectively allowing linkage of two, three, five or a greater number of antivibration bars constituting a set of aligned bars.

According to the invention, the linkage devices such as 16, 17, 18 and 19 may be produced from identical modular elements, which will be described below.

Similarly, the end parts of the antivibration bars 15' interposed between the layers of tubes arranged in a network with triangular cells, as represented in FIG. 2B, may be connected using linkage means such as 16', 17', 18' and 19', making it possible to join together the ends of a set of two, four, five or more than five antivibration bars, respectively.

In all cases, the ends 15*b* or 15'*b* of the antivibration bars which are joined together by a linkage device such as 16, 17, 18 and 19 or 16', 17', 18' and 19' are transversed by openings aligned on an axis perpendicular to the ends of the antivibration bars.

Figure 3:
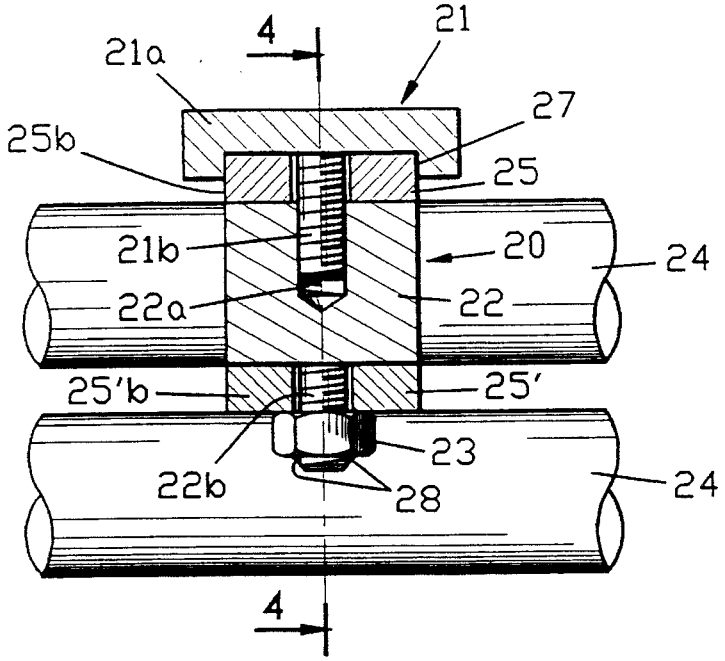
FIG. 3 is a view in section through a plane perpendicular to the layers of the tubes of the bundle, of a first embodiment of a device for linkage of antivibration bars.
Figure 4:
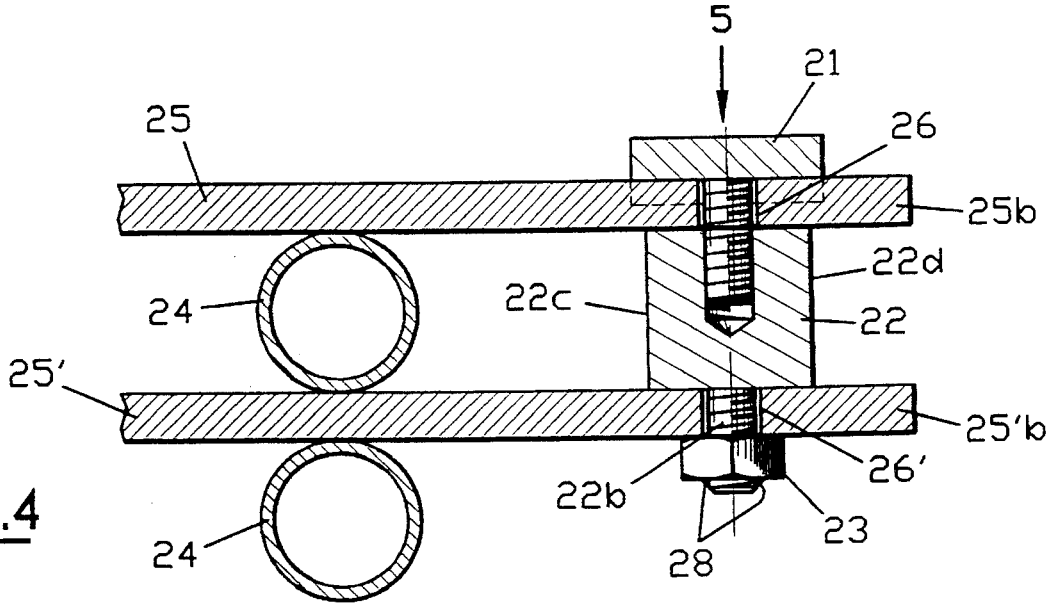
FIG. 4 is a view in section along 4—4 in FIG. 3.
Figure 5:
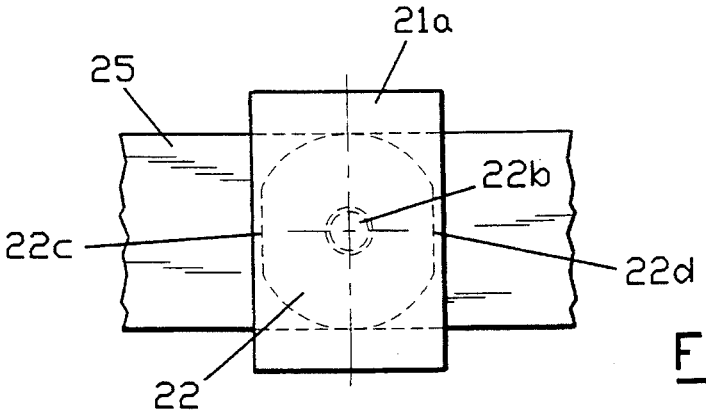
FIG. 5 is a plan view in the direction of arrow 5 in FIG. 4.

Reference will now be made to FIGS. 3 to 5 in order to describe the linkage means of a blocking device according to the invention making it possible to join together the ends of two antivibration bars.

Such a device, referenced 20 in FIGS. 3 to 5, is similar to the device 16 or 16' represented in FIGS. 2A and 2B, respectively.

The device 20, which makes it possible to link together the end parts 25*b* and 25'*b* of two antivibration bars 25 and 25' arranged in two successive spaces between rows of tubes 24, includes a screw 21, a spacer 22 and a nut 23. The screw 21 includes a head 21*a* which is solidly attached to a threaded rod 21*b*.

The spacer 22 includes a tapped opening 22*a* and a threaded rod 22*b* which are arranged along the axis of the spacer, the rod 22*b* projecting with respect to the end of the spacer 22 which is opposite its end on which opens the tapped opening 22*a*, which is in the form of a blind hole.

The threaded rod 21*b* of the screw 21 and the tapped opening 22*a* of the spacer 22 permit rod 21*b* to be screwed into opening 21*a*.

The rod 22*b* extending the spacer 22 in the axial direction has a screw thread identical to the screw thread of the rod 21*b* of the screw 21, which makes it possible, in certain embodiments which will be described hereinbelow, to fasten the spacers 22 constituting the modular elements in the extension of each other.

The linkage device 20 further includes a nut 23 whose tapped opening allows it to be screwed on the threaded rod 22*b* extending the spacer 22.

The antivibration bars 25 and 25' are traversed by respective openings 26 and 26' whose diameter is greater than the diameter of the rod 21*b* of the screw and of the rod 22*b* of the spacer which have, as indicated hereinabove, identical screw threads and diameters.

As can be seen in FIG. 5, the head 21*a* of the screw 21 has substantially the shape of a square whose side has a length greater than the width of an antivibration bar such as 25.

The head inner face of 21*a* of the screw includes, a cavity 27 having two parallel edges which passes through the screw head over its entire length, the width of which is substantially equal to the width of an antivibration bar such as 25.

The presence of the cavity 27 on the lower face of the screw head 21*a* makes it possible to engage the screw head on the antivibration bar 25, during mounting of the linkage device 20. This provides rotational locking of the screw with respect to the antivibration bar 25.

It is clear that the screw head 21*a* might also have the shape of a circular disc in which the cavity 27 might be machined around the screw rod 21*b*.

The spacer 22 has a body of substantially cylindrical shape extended by the rod 22*b* which is coaxial with the cylindrical body of the spacer 22.

The body of the spacer 22 has flat mating surfaces 22*c* and 22*d* on its outer surface (FIG. 5) which make it possible to engage the body of the spacer with a tightening device such as a key for screwing it during mounting of the linkage device 20.

The linkage device 20 is mounted between the end parts 25*b* and 25'*b* of two antivibration bars 25 and 25' situated in intervals between successive rows of tubes 24 during mounting of the bundle of the steam generator, this mounting generally being carried out by successive layers of tubes, the steam generator being positioned with its axis substantially horizontal.

The antivibration bars are interposed between the layers of tubes which are arranged on each other in a stack to constitute the bundle.

When two successive layers between which antivibration bars have been interposed have been stacked, a new set of antivibration bars is arranged above the last layer of tubes laid and engaged in the openings of the tube plate of the steam generator.

The linkage is then carried out of the ends of the antivibration bars such as 25 and 25' arranged between the two layers of tubes 24 which have just been laid and above the last layer laid, respectively.

In order to link together two antivibration bars 25 and 25' by using a device 20 as represented in FIG. 3, the screw head is directed such that the cavity 27 lies in the direction of the width of the antivibration bar 25 and is engaged on the antivibration bar 25. The rod 21*b* of the screw 21 is introduced into the opening 26 of the antivibration bar 25. The spacer 22 is then introduced between the end parts of the antivibration bars 25 and 25', the threaded rod 22*b* of the spacer 22 being engaged in the opening 26' of the antivibration bar 25'.

The spacer 22 can easily be interposed between the antivibration bars 25 and 25', because the bar 25 is simply placed on the last layer of tubes laid.

It is then possible to tighten the linkage device using a tightening key engaging with the mating surfaces 22*c* and 22*d* of the spacer 22. The spacer 22 is screwed onto the screw rod 22*b* and the screw 21 and the spacer 22 are tightened against the bar 25 which is engaged in the cavity 27.

The nut 23 is engaged on the end of the rod 22b of the spacer 22 in order to lock the spacer.

The rotational locking of the linkage device 20 is completed by welding points 28 between the nut 23 and the end part of the rod 22*b* of the spacer 22.

Engaging the screw head 21*a* on the antivibration bar 25 via the cavity 27 makes it possible to lock the screw rotationally with respect to the spacer, the rotational locking of the spacer with respect to the nut 23 being ensured by the welding points 28.

The threaded parts 21*b* of the screw 21 and 22*b* of the spacer 22 have a length greater than the thickness of the antivibration bars 25 and 25', so that these threaded rods have parts projecting with respect to the through openings 26 and 26' of the antivibration bars which are screwed respectively into the spacer 22 and through the nut 23.

The tapped opening 22*a* of the spacer 22 has sufficient length to receive the rod of the screw.

The pitches of the screw threads of the rods 21*b* and 22*b*, of the tapped opening 22*a* and of the tapped bore of the nut 23 are provided in senses allowing tightening of the two rods inside the tapped openings.

In certain cases, for reasons of bulk, it is not possible to fasten the linkage device by means of a nut screwed and then welded onto the end of the rod of the spacer.

Figure 7:
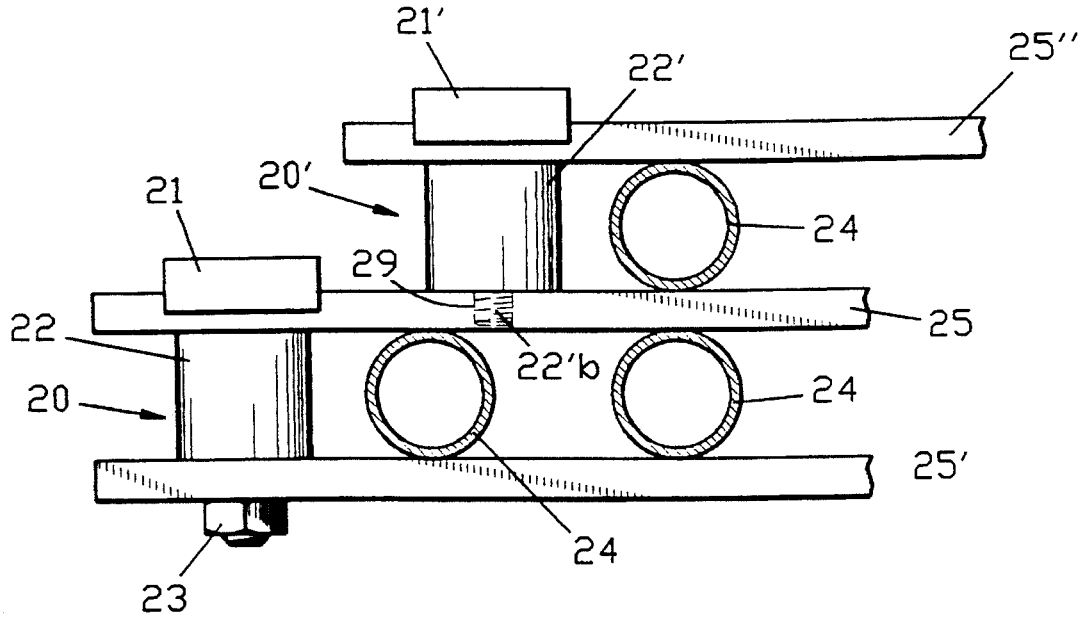
FIG. 7 is a plan view of means of linkage of antivibration bars of a blocking device according to a variant of the first embodiment.

In this case, it is possible, as represented in FIG. 7, to fasten the threaded rod of the end of the spacer in a tapped opening of an antivibration bar, this tapped opening being identical to the tapped bore of the nut.

FIG. 7 thus represents a first device 20 for linking two antivibration bars 25 and 25' which is identical to the device which has just been described.

A second device 20' has also been represented for linkage between an antivibration bar 25" and the bar 25, which includes a screw 21' and a spacer 22' which are identical to the screw 21 and to the spacer 22 of the device 20.

In contrast to the device 20, the device 20' includes no fastening nut 23, the spacer 22' being screwed, by means of its rod 22'*b*, in a tapped opening 29 machined in the antivibration bar 25.

The linkage device 20' is fitted and then tightened in a single operation, by screwing the spacer 22' simultaneously into the tapped opening 29 and onto the rod of the screw 21' which engages in the tapped opening of the spacer 22'.

Figure 6:
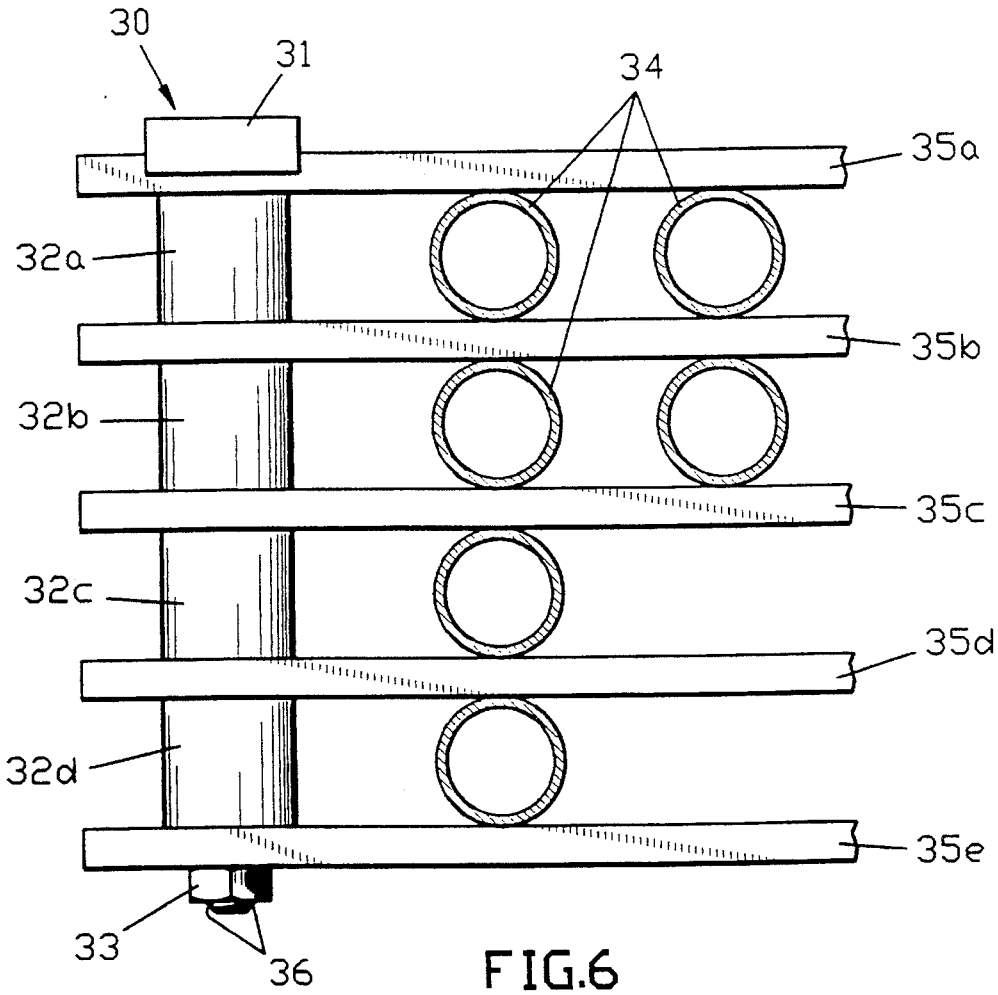
FIG. 6 is a view in plan and in partial section of a means of linkage of a set of antivibration bars of a blocking device according to a second embodiment of the invention.

FIG. 6 represents a linkage device 30 making it possible to link five successive antivibration bars 35*a*, 35*b*, 35*c*, 35*d* and 35*e*. This device is substantially equivalent to the device 18 or 18' represented in FIGS. 2A and 2B, respectively:

The linkage device 30 includes a screw 31 which is substantially identical to the screw 21 of the device 20 which has been described hereinabove, and four identical spacers 32*a*, 32*b*, 32*c* and 32*d* which are arranged in sequence in a direction of alignment of the antivibration bars 35*a*, 35*b*, 35*c*, 35*d* and 35*e* along which the antivibration bars are pierced with aligned openings.

The threaded rod of the screw 31 is engaged in the opening of the first antivibration bar 35*a*, and the head of the screw 31 is engaged on this antivibration bar, so as to be locked in rotation.

The first spacer 32*a* is screwed by means of its tapped opening onto the rod of the screw 31 and by means of the threaded rod which axially extends the spacer away from the tapped opening, and which is engaged in the opening of the antivibration bar 35*b*, into the tapped opening of the second spacer 32*b*.

The second spacer 32*b* is itself screwed onto the threaded rod of the first spacer 32*a* and inside the tapped opening of the third spacer 32*c*.

It is thus possible successively to tighten and fasten rows of antivibration bars interposed between the layers of tubes 34.

The last spacer 32*d* arranged between the antivibration bars 35*d* and 35*e* includes a threaded rod which passes through the last antivibration bar 35*e* and which includes a projecting part on which a locking nut 33 is fastened, which is tightened and then fastened by welding points 36 onto the threaded rod of the last spacer 32*d*.

It is clear that the last spacer 32*d* might also be fastened by its threaded rod, inside a tapped opening machined in the last antivibration bar 35*e*.

It should be noted that the device 30 may include any number of identical spacers in order to link together any number of antivibration bars of an assembly constituting an aligned row.

In all cases, whatever the number of antivibration bars of the set of aligned bars, a single locking screw 31 and a single nut 33 are used, only the number of spacers interposed between the antivibration bars being variable. Whatever the number of antivibration bars which are being linked, the screw 31 and the nut 33 are identical.

It is thus possible to link any number of aligned antivibration bars, by using modular elements which must simply be supplied in sufficient numbers at the construction site of the steam generator.

In certain cases, especially when there is no attachment at the central part, the antivibration bars must be held by devices allowing prevention of their ejection.

Such a device, denoted by the reference 37 in FIG. 2A, has been represented, in the case of a tube bundle with square pitch, and in FIG. 2B, in the case of a tube bundle with triangular pitch.

The device 37 is constructed in the form of a retaining bar which is generally denoted by the term anti-liftoff retaining bar, because its function is to prevent upward ejection of the antivibration bars.

Figure 8:
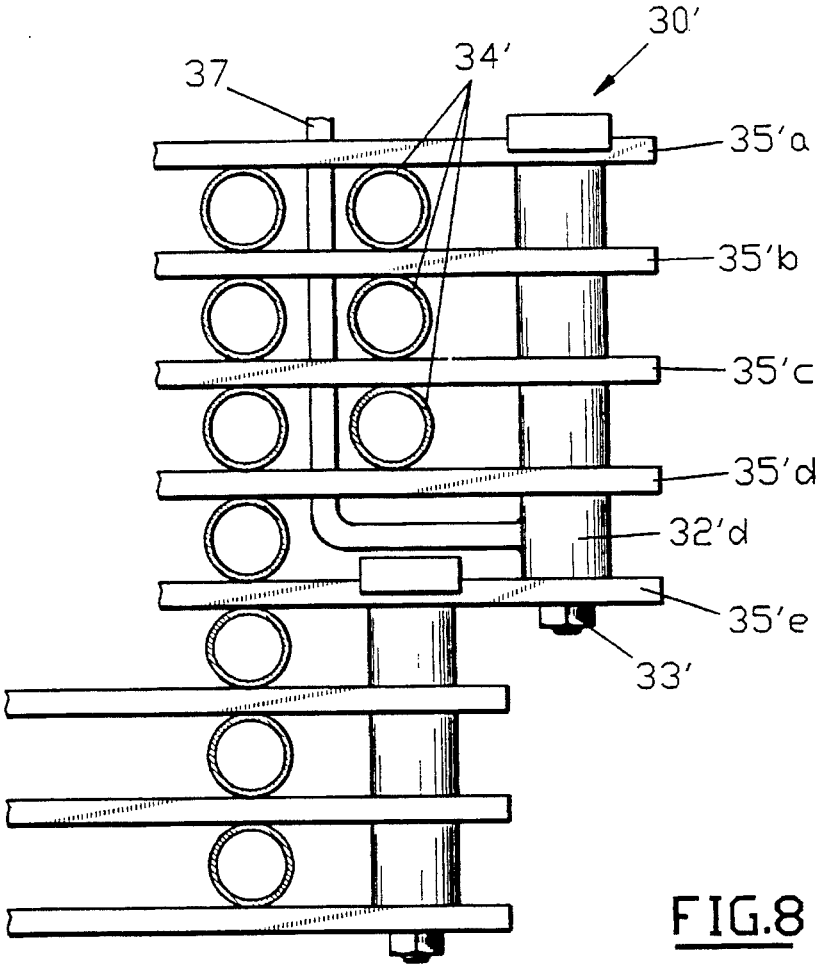
FIG. 8 is a plan view of a part of a blocking device according to the invention, including a retaining bar for holding the tubes of the bundle.
Figure 9:
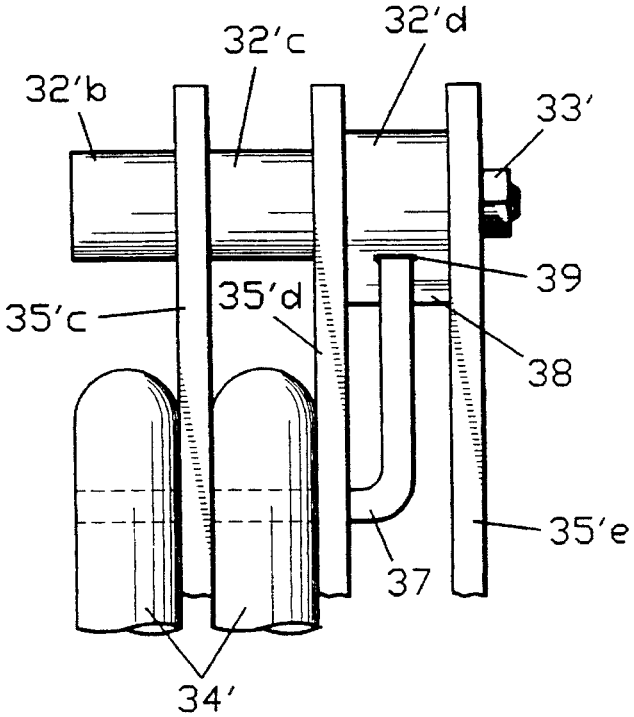
FIG. 9 is a view on a larger scale of a detail of the fastening of the retaining bar represented in FIG. 8.

FIGS. 8 and 9 represent an anti-liftoff retaining bar 37 and the means for fastening it on an antivibration bar linkage device according to the invention.

FIG. 8 shows a set of antivibration bars 35'*a*, 35'*b*, 35'*c*, 35'*d* and 35'*e* which are joined together by a linkage device 30' similar to the device 30 represented in FIG. 6.

An anti-liftoff retaining bar 37 is fastened by the end of one of its branches on a spacer 32'*d* of the linkage device 30' arranged at the end of the row of antivibration bars.

The retaining bar 37 may be fastened at the end of its second branch, at its second end (not shown), on a spacer of a linkage device identical to the device 30' which links the end parts of a set of antivibration bars.

In FIGS. 2A and 2B, the retaining bar 37 makes it possible to ensure anti-liftoff holding of the set of antivibration bars. The ends of the retaining bar are fastened in two spacers of two devices according to the invention for linking the ends 15'*b* of the antivibration bars 15' which are introduced between the layers of tubes 14'.

As can be seen in FIG. 9, the end spacer 32'*d* of the linkage device 30' into which the branch of the retaining bar 37 is fastened is extended by a lug 38 for fastening the retaining bar 37, into which a curved end part of the fastening bar is introduced and fastened by a weld 39.

It is also possible to use an end spacer 32'*d* which is larger than the other spacers, so as to be able to be pierced in order to receive the end part of the retaining bar 37.

The device according to the invention makes it possible simply and effectively to fasten the anti-liftoff retaining bars of the antivibration bars, during mounting of the bundle of the steam generator.

The blocking device according to the invention, including linkage devices consisting of identical screws and spacers, makes it possible simply and quickly to link any number of antivibration bars during the mounting of the bundle of the steam generator, by using only modular elements having standard dimensions.

The blocking device according to the invention furthermore makes it possible effectively and simply to fasten anti-liftoff retaining bars of the antivibration bars.

The, screw and the spacers of the devices for linking the antivibration bars may be produced in a form which is different from that which has been described.

The invention applies in the case of any steam generator or heat exchanger including a regular network of tubes including bent parts between which antivibration bars are interposed.

We claim:

1. A device for antivibrational blocking of tubes of a heat exchanger including a bundle of tubes folded into a U, ends of said tubes being fixed in a tube plate arranged in parallel layers and juxtaposed bent parts of said tubes opposite said tube plate constituting an assembly of substantially hemispherical shape, termed tube bend region, said blocking device including a set of antivibration bars each interposed between the bent parts of two adjacent layers of tubes of said bundle and arranged substantially radially of said tube bend region, so as to have one end outside said tube bend region, and linkage means linking outer end parts of said antivibration bars arranged in a plurality of sets of at least two bars in which the bars are aligned along a straight row and include aligned through openings, wherein said linkage means include, for each of said sets of antivibration bars aligned along one row:

(a) a screw having a head intended to bear on a first face of a first antivibration bar at one of the row and including means of locking against rotation with respect to said first antivibration bar and a threaded rod engaged in the opening of said first antivibration bar, so as to project on a second face of said first antivibration bar opposite said first face;

(b) at least one spacer having a longitudinal axis and a body having a length along an axis of said spacer substantially equal to a separation between two successive bars of the row and including, along the axis of said body, a tapped opening extending over part of a length of said body and emerging at a first axial end of said body of said spacer and a threaded rod in axial extension of said body, at a longitudinal end of said body opposite said first end as well as an engaging surface on the outer surface of said body; and (c) a tapped fastening element associated with a second antivibration bar different from said first antivibration bar;

(d) said threaded rod of said screw having a screw thread allowing it to be fastened by screwing in said tapped opening of said spacer, and said threaded rod of said spacer having an identical screw thread allowing it to be fastened in a tapped opening of said tapped fastening element or in a tapped spacer opening.

2. The device according to claim 1, wherein said tapped fastening element is a nut screwed onto said threaded rod of said spacer, bearing against said second antivibration bar and connected by welding points to said threaded rod of said spacer.

3. The device according to claim 1, wherein said tapped fastening elements consists of a through opening of said second antivibration bar in the form of a tapped opening to allow screwing of said rod of said spacer.

4. The device according to any one of claims 1 to 3, including at least one means of linking a set of more than two aligned antivibration bars, said linking means comprising a screw, at least two identical spacers and a tapped fastening element.

5. The device according to any one of claims 1 to 3, wherein said head of said screw includes a rotational locking means consisting of a cavity with parallel edges of a width substantially equal to a width of an antivibration bar, in which said first antivibration bar is housed.

6. The device according to any one of claims 1 to 3, including at least one anti-liftoff retaining bar in the shape of a staple, including two branches each fixed at its ends onto a spacer of a linkage means of a set of antivibration bars.

* * * * *